US008007351B1

(12) United States Patent
Maloney

(10) Patent No.: US 8,007,351 B1
(45) Date of Patent: Aug. 30, 2011

(54) MOBILE PERSONNEL BIO ISOLATION DEVICE AND METHOD FOR PROTECTING THE INTERIOR OF AN AMBULANCE FROM CONTAMINATION

(76) Inventor: Raymond C. Maloney, Northport, NY (US)

( * ) Notice: Subject to any disclaimer, the term of this patent is extended or adjusted under 35 U.S.C. 154(b) by 567 days.

(21) Appl. No.: 11/129,907

(22) Filed: May 16, 2005

(51) Int. Cl.
*F24F 7/00* (2006.01)

(52) U.S. Cl. ..... 454/187; 600/21

(58) Field of Classification Search ..... 237/3, 14; 454/187; 600/21
See application file for complete search history.

(56) References Cited

U.S. PATENT DOCUMENTS

| | | | | |
|---|---|---|---|---|
| 3,265,059 | A * | 8/1966 | Matthews | 600/21 |
| 3,272,199 | A * | 9/1966 | Matthews | 600/21 |
| 3,348,890 | A * | 10/1967 | Trexler | 312/3 |
| 3,678,921 | A * | 7/1972 | Brendgord et al. | 600/21 |
| 3,777,736 | A * | 12/1973 | Van Der Waaij et al. | 600/21 |
| 4,304,224 | A * | 12/1981 | Fortney | 600/21 |
| 4,335,712 | A * | 6/1982 | Trexler | 600/21 |
| 4,367,728 | A * | 1/1983 | Mutke | 600/21 |
| 4,612,916 | A * | 9/1986 | Akers et al. | 600/21 |
| 4,928,581 | A * | 5/1990 | Jacobson | 454/340 |
| 5,010,907 | A * | 4/1991 | Henson et al. | 134/103.2 |
| 5,136,735 | A * | 8/1992 | Zimmerman | 4/597 |
| 5,236,390 | A * | 8/1993 | Young | 454/95 |
| 5,706,846 | A * | 1/1998 | Sutton | 135/128 |
| 5,865,722 | A * | 2/1999 | Heng | 600/21 |
| 5,891,066 | A | 4/1999 | Borschneck et al. | |
| 6,321,764 | B1 * | 11/2001 | Gauger et al. | 135/128 |
| 6,461,290 | B1 * | 10/2002 | Reichman et al. | 600/21 |
| 6,485,683 | B1 | 11/2002 | Walles | |
| 6,488,029 | B1 * | 12/2002 | Hood et al. | 128/845 |
| 6,971,985 | B2 * | 12/2005 | Perlatti | 600/21 |
| 7,017,306 | B2 * | 3/2006 | Ryder | 52/36.1 |
| 2002/0045796 | A1 * | 4/2002 | O'Connor et al. | 600/21 |
| 2004/0050008 | A1 * | 3/2004 | Mintie et al. | 52/646 |

* cited by examiner

*Primary Examiner* — Steven B. McAllister
*Assistant Examiner* — Samantha Miller
(74) *Attorney, Agent, or Firm* — Leo G. Lenna

(57) ABSTRACT

An enclosure which forms a biological chemical barrier system and has a bottom wall that rests on a gurney so as to be mobile while housing a patient on a backboard or mattress placed therein. A front wall of the enclosure has biomedical ports and an air filtration system therein. A rear wall of the enclosure has an access door therein formed by a hinged portion thereof cut therefrom and selectively closed by a zipper. Side walls of the enclosure have sleeve gloves therein. A top wall of the enclosure has a plurality of hanger straps thereon that extend upwardly therefrom, for wrapping around an associated personnel pole, and are relaseably maintained thereon by complementary portions of hook and loop pile fasteners disposed on themselves.

1 Claim, 2 Drawing Sheets

FIG. 1
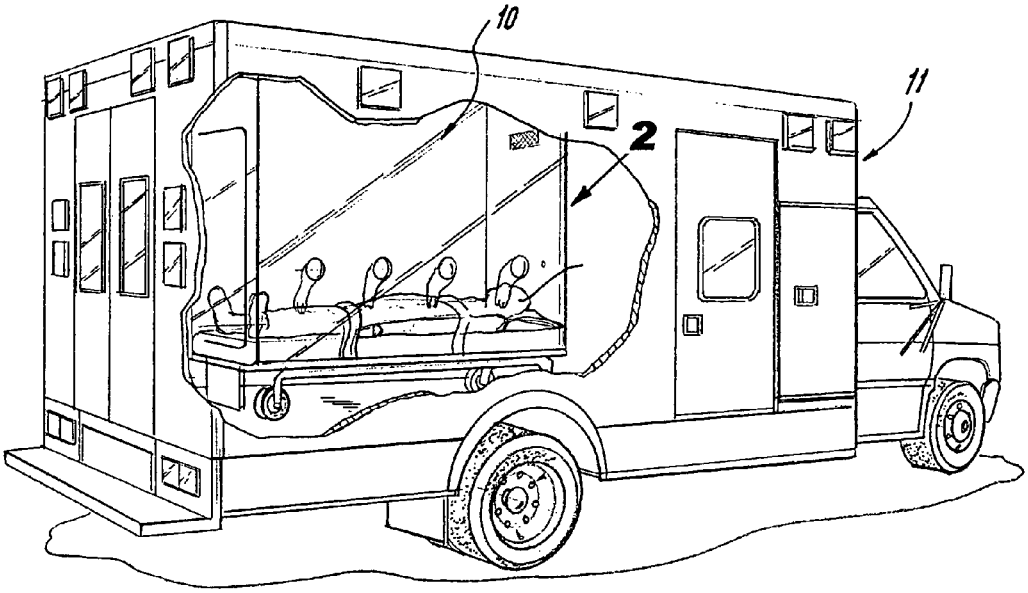
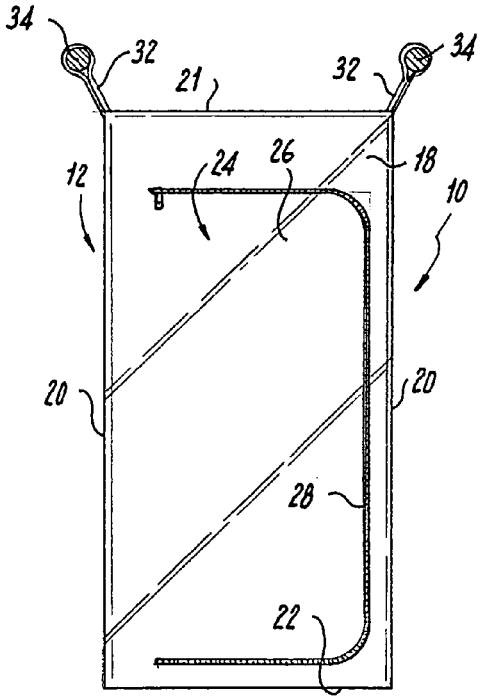
FIG. 3
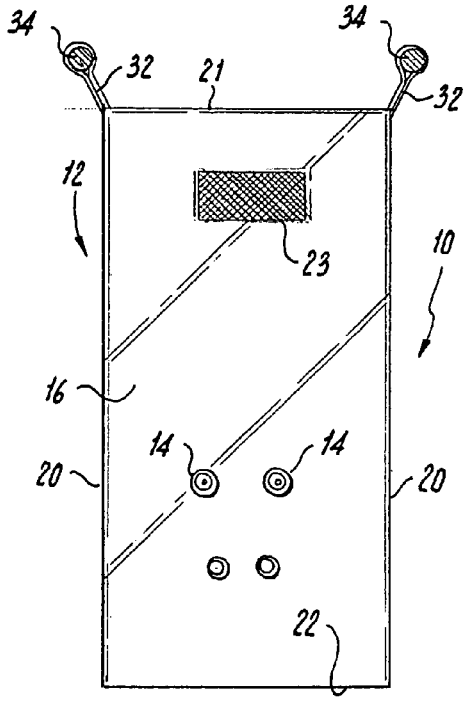
FIG. 4

FIG. 2
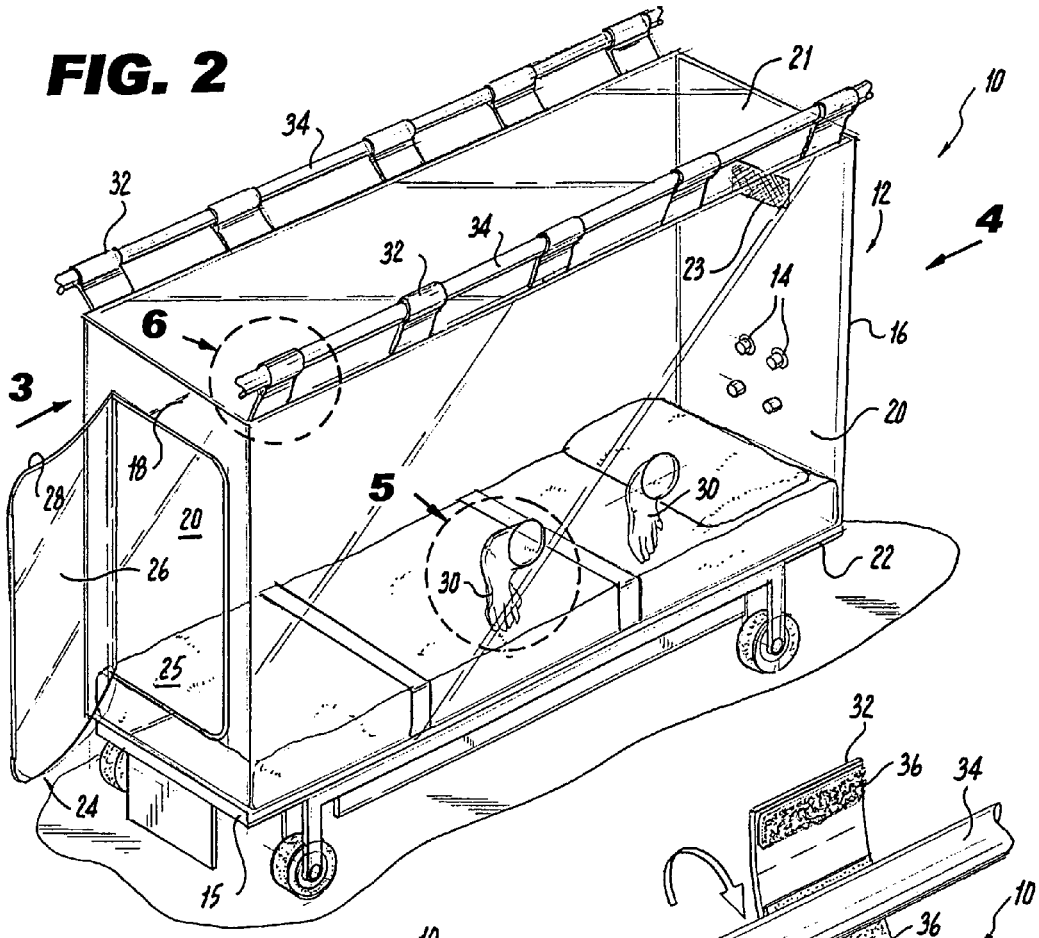
FIG. 5
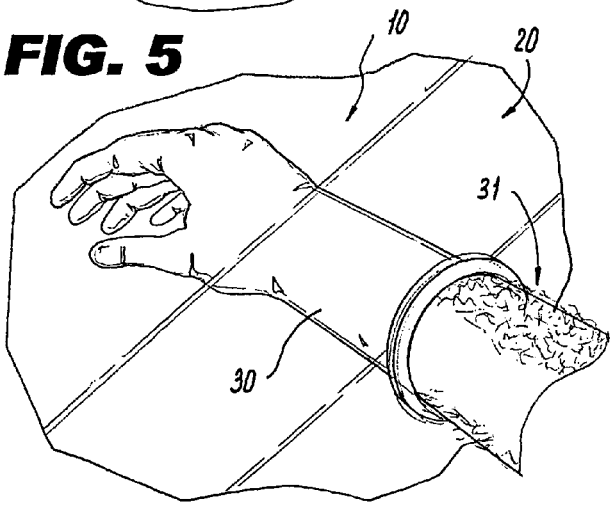
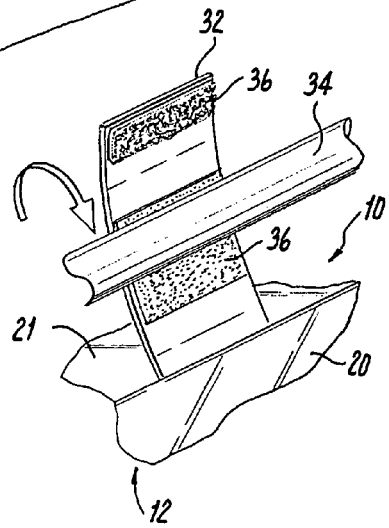
FIG. 6

MOBILE PERSONNEL BIO ISOLATION DEVICE AND METHOD FOR PROTECTING THE INTERIOR OF AN AMBULANCE FROM CONTAMINATION

CROSS REFERENCE TO RELATED APPLICATIONS

The instant application contains subject matter disclosed in applicant's Disclosure Document No. 570548 filed on Feb. 14, 2005, and as such, it is respectfully requested in a separate paper attached herewith that this Disclosure Document be relied upon and remain a permanent part of the file history during the prosecution of the instant application and during any subsequent action thereof.

BACKGROUND OF THE INVENTION

1. Field of the Invention

The present invention relates to an isolation device, and more particularly, the present invention relates to a mobile personnel bio isolation device, for protecting Emergency Medical Technicians and the interior of a vehicle in which they and a contaminated patient occupy.

2. Description of the Prior Art

Numerous innovations for isolation devices have been provided in the prior art that will be described.

A FIRST EXAMPLE, U.S. Patent Office Document No. 5,891,066, Issued on Apr. 6, 1999, to Borschneck et al. teaches a bag-like container of flexible plastic material that snugly confines the ischial padding and body of an emergency traction splint for an injured leg while allowing access to the traction-inducing components thereof. Additional biohazard shielding is afforded by an integral cover of flexible, impervious material sufficiently rigid to provide a protective enclosure for patient transport. The container and the cover as well as the attendant malleolar harness are disposable. A barrier against cross-contamination from biohazards present in human body fluids is provided.

A SECOND EXAMPLE, U.S. Pat. No. 6,461,290 B1, Issued on Oct. 8, 2002, to Reichman et al. teaches a collapsible, transportable personnel isolation apparatus or device that is used to isolate a patient in a controlled environment and to protect the patient against biological or chemical hazards during transport of the patient. The collapsible apparatus has a flexible containment wall which is expandable from a collapsed, stored state to an expanded state to receive the patient. At least a portion of the containment wall is clear to allow observation of the patient within an interior region of the device. An air filtration system is provided for filtering air between the airtight interior region and the ambient atmosphere. Preferably, the apparatus has various ports therein, such as glove ports, pass through ports, access ports for cardiac leads, infusion line ports, and ventilation ports. Preferably, an air filtration device provides a flow rate of 4 to 6 cfm to prevent an undesirable build-up of carbon dioxide and provides a predetermined air pressure within the interior regions. In one form, the containment device is a clam shell litter type for transport of a prone patient and in another form the device is a jacket type with a hood defining an air impermeable chamber for an ambulatory patient who carries an ambulatory air filtration device for supplying and filtering the air impermeable chamber.

A THIRD EXAMPLE, U.S. Pat. No. 6,485,683 B1, Issued on Nov. 26, 2002, to Walles teaches a Pyro sulfuric acid that is employed to decontaminate air. Contaminated air is contacted with pyro sulfuric acid in a pyro sulfuric acid system, and released as decontaminated air. The system can be especially useful in a chemical/biological/nuclear defense module.

It is apparent that numerous innovations for isolation devices have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

ACCORDINGLY, AN OBJECT of the present invention is to provide a mobile personnel bio isolation device that avoids the disadvantages of the prior art.

ANOTHER OBJECT of the present invention is to provide a mobile personnel bio isolation device that is simple to use.

BRIEFLY STATED, STILL ANOTHER OBJECT of the present invention is to provide a mobile personnel bio isolation device, which is an enclosure that forms a biological chemical barrier system and has a bottom wall that can rest on a gurney so as to be mobile while housing a patient on a backboard or mattress placed therein. A front wall of the enclosure has biomedical ports and an air filtration system therein. A rear wall of the enclosure has an access door therein formed by a hinged portion thereof cut therefrom and selectively closed by a zipper. Side walls of the enclosure have sleeve gloves therein. A top wall of the enclosure has a plurality of hanger straps thereon that extend upwardly therefrom, for wrapping around an associated personnel pole, and are relaseably maintained thereon by complementary portions of hook and loop pile fastener material disposed on themselves.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows:

FIG. 1 is a diagrammatic perspective view of an ambulance, with parts broken away showing the mobile personnel bio isolation device of the present invention therein;

FIG. 2 is an enlarged diagrammatic perspective view of the mobile personnel bio isolation device of the present invention identified by ARROW 2 in FIG. 1, showing the access door open;

FIG. 3 is an enlarged diagrammatic end elevational view taken generally in the direction of ARROW 3 in FIG. 2 of the door of the mobile personnel bio isolation device of the present invention, showing the access door closed;

FIG. 4 is an enlarged diagrammatic end elevational view taken generally in the direction of ARROW 4 in FIG. 2;

FIG. 5 is an enlarged diagrammatic perspective view of the area generally enclosed by the dotted curve identified by ARROW 5 in FIG. 2 of a typical sleeve glove of the mobile personnel bio isolation device of the present invention in use; and FIG. 6 is an enlarged diagrammatic perspective view of the area generally enclosed by the dotted curve identified by ARROW 6 in FIG. 2 of a typical hanger strap of the mobile personnel bio isolation device of the present invention ready to be secured to a personnel pole of the ambulance.

LIST OF REFERENCE NUMERALS UTILIZED IN THE DRAWING

| | |
|---|---|
| 10 | mobile bio isolation device of present invention |
| 11 | ambulance |
| 12 | enclosure for resting on gurney 15 so as to be mobile |
| 14 | least one or a plurality of biomedical ports in enclosure 12 |
| 15 | gurney |
| 16 | front wall of enclosure 12 |
| 18 | rear wall of enclosure 12 |
| 20 | side wall of enclosure 12 |
| 21 | top wall of enclosure 12 |
| 22 | bottom wall of enclosure 12 |
| 23 | air filtration system in front wall 18 of enclosure 12 |
| 24 | access door in rear wall 18 of enclosure 12 |
| 25 | backboard or mattress |
| 26 | hinged portion cut from rear wall 18 of enclosure 12 to form access door 24 in rear wall 18 of enclosure 12 |
| 27 | contaminated patient |
| 28 | zipper of access door 24 in rear wall 18 of enclosure 12 |
| 30 | one sleeve glove, or a plurality of sleeve gloves in side wall 20 |
| 31 | medical person |
| 32 | plurality of hanger straps 32 of top wall 21 of enclosure 12 for suspending enclosure 12 therefrom |
| 34 | pair of personnel poles |
| 36 | complementary portions of hook and loop pile fasteners of each hanger strap of plurality of hanger straps 32 |

DETAILED DESCRIPTION OF THE PREFERRED EMBODIMENT

Referring now to the figures, in which like numerals indicate like parts, and particularly to FIG. 1, which is a diagrammatic perspective view of an ambulance 11, with parts broken away, is shown the mobile personnel bio isolation device of the present invention therein generally at 10.

The overall configuration of the mobile personnel bio isolation device 10 can best be seen in FIGS. 2-5, which are, respectively, an enlarged diagrammatic perspective view of the mobile personnel bio isolation device of the present invention identified by ARROW 2 in FIG. 1 showing the door open; an enlarged diagrammatic end elevational view taken generally in the direction of ARROW 3 in FIG. 2 of the mobile personnel bio isolation device of the present invention showing the access door closed; an enlarged diagrammatic end elevational view taken generally in the direction of ARROW 4 in FIG. 2; and, an enlarged diagrammatic perspective view of the area generally enclosed by the dotted curve identified by ARROW 5 in FIG. 2 of a typical sleeve glove of the mobile personnel bio isolation device of the present invention in use, and as such, will be discussed with reference thereto.

The mobile personnel bio isolation device 10 comprises an enclosure 12 having biomedical ports 14. The enclosure 12 is intended for resting on gurney 15 so as to be mobile and forms a completely enclosed secure biological chemical barrier system so that fluids or any other possible contaminates or infectious materials expelled by a patient will be contained within the enclosure 12 and thereby prevent the ambulance or personnel from being contaminated.

The enclosure 12 is generally rectangular-parallelepiped-shaped, and has a front wall 16, a rear wall 18, a pair of side walls 20, a top wall 21, and a bottom wall 22.

The enclosure 12 is intended to be formed of a clear semi-flexible plastic material such that when it is stored in a proper folded manner, before first time use, because of its rectangular-parallelepiped-shape it will be sufficiently rigid enough to support itself when unfolded. Yet when necessary to dispose of the enclosure, preferably after one time use, it can be accordingly easily and quickly fold and crinkled up into a small volume so that it may be destroyed in a safe appropriate manner.

The front wall 16 of the enclosure 12 has at least one or a plurality of biomedical ports 14 therein and an air filtration system 23.

The rear wall 18 of the enclosure 12 has an access door 24 thereat. The access door 24 in the rear wall 18 of the enclosure 12 is formed by a hinged portion 26 thereof cut therefrom and selectively closed by a zipper 28.

One of the pair of side walls 20 of the enclosure 12 has at least one sleeve glove 30, or a plurality of sleeve gloves 30 therein, so that a medical person 31 can assist a patient that is contained within the enclosure 12 which forms a biological chemical barrier system and has a bottom wall 22 that can rest on a gurney 15 so as to be mobile while housing a patient on a backboard or mattress 25 placed therein.

The top wall 21 of the enclosure 12 has a plurality of hanger straps 32 thereat. The plurality of hanger straps 32 of the top wall 21 of the enclosure 12 are for suspending the enclosure 12 therefrom.

The interior of the ambulance normally has personnel poles 34 for medical persons to steady themselves when riding therein, and accordingly the mobile personnel bio isolation device 10 further comprises a plurality of hanger straps 32 connected to the top wall 21 of the enclosure 12 to suspend the enclosure 12 therefrom.

The specific configuration of each hanger strap 32 can best be seen in FIG. 6, which is an enlarged diagrammatic perspective view of the area generally enclosed by the dotted curve identified by ARROW 6 in FIG. 2 of a typical hanger strap of the mobile personnel bio isolation device of the present invention ready to be secured to a personnel pole, and as such, will be discussed with reference thereto.

Each hanger strap 32 extends upwardly from the top wall 21 of the enclosure 12, wraps around an associated personnel pole 34, and is relaseably maintained thereat by complementary portions of hook and loop pile fasteners 36 disposed on itself.

When it is appropriate for transporting a contaminated patient in the ambulance 11 to a destination, without contaminating the ambulance, the interior of the ambulance is first prepared by placing a gurney in the ambulance and securing it in place if required;

Then unfolding a mobile personnel bio isolation device of the present invention 10 and hanging it, above the gurney, securely in place by wrapping a plurality of hanger straps 32 around the personnel poles in the ambulance and securing the straps firmly utilizing the complementary portions of hook and loop pile fastener material 36;

Optionally placing a mattress in the enclosure 25;

Placing a contaminated patient 27 in the mobile personnel bio isolation device 10 of the present invention. If ambulatory, the patient may climb in and recline on a mattress. If immobile, the patient may be first placed on an appropriate backboard and then placed into the mobile personnel bio isolation device 10;

Accordingly securely zipping the door 24 in a closed position;

Transporting the ambulance with the patient, and EMT personnel to a desired destination; and Upon arriving at the desired destination, disengaging the hanger straps 32 from the personnel poles 34 and removing the gurney with the mobile personnel bio isolation device of the present invention 10 resting thereon with the contaminated patient 27 inside without unzipping the door 24 and allowing the patient to be removed therefrom by others taking appropriate protective measures and precautions.

It will be understood that each of the elements described above, or two or more together, may also find a useful application in other types of constructions differing from the types described above.

While the invention has been illustrated and described as embodied in a mobile personnel bio isolation device, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A method of transporting a contaminated patient in an ambulance, without contaminating said ambulance, to a destination comprising the steps of:

a) placing a gurney in said ambulance and securing it in place;

b) unfolding a mobile personnel bio isolation device comprising a continuous single walled enclosure having a front wall, a rear wall, a pair of side walls, a top wall and a bottom wall all made from flexible plastic material that when unfolded is rigid enough to support itself in the unfolded configuration, said enclosure having at least one biomedical port therein, a multiplicity of hanger straps for attaching to personnel poles to support said enclosure in a an unfolded manner and at least one access door formed by a hinged portion cut there from that is selectively closed by a zipper;

c) hanging said enclosure above said gurney securely in place by wrapping a plurality of hanger straps around personnel poles in said ambulance and securing said plurality of hanger straps firmly utilizing a complementary portions of hook and loop pile fastener material;

d) placing a mattress in said mobile personnel bio isolation device:

e) placing a patient on an appropriate backboard, if the patient is immobile;

f) placing the patient in said mobile personnel bio isolation device;

g) securely zipping said door of said mobile personnel bio isolation device in a closed position;

h) transporting said ambulance with the patient to a desired destination;

i) upon arriving at said desired destination, disengaging said hanger straps from said personnel poles and then removing said gurney with said mobile personnel bio isolation device, resting on said gurney with the patient inside without unzipping said door; and j) allowing the patient to be removed therefrom by others.

* * * * *